US007257353B2

(12) United States Patent
Kawai et al.

(10) Patent No.: US 7,257,353 B2
(45) Date of Patent: Aug. 14, 2007

(54) DEVELOPING APPARATUS

(75) Inventors: Tachio Kawai, Odawara (JP); Seiji Yamaguchi, Mishima (JP); Syuhei Kawasaki, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 237 days.

(21) Appl. No.: 11/094,372

(22) Filed: Mar. 31, 2005

(65) Prior Publication Data

US 2006/0045574 A1 Mar. 2, 2006

(30) Foreign Application Priority Data

Aug. 30, 2004 (JP) ..... 2004-250736
Feb. 28, 2005 (JP) ..... 2005-054126

(51) Int. Cl.
*G03G 15/08* (2006.01)

(52) U.S. Cl. ..... 399/254; 399/111

(58) Field of Classification Search ..... 399/107, 399/111, 119, 120, 222, 252, 254, 255, 256
See application file for complete search history.

(56) References Cited

U.S. PATENT DOCUMENTS 4,577,587 A * 3/1986 Kamezaki ..... 399/254
5,465,140 A 11/1995 Nakamura et al. ..... 355/260
5,903,803 A 5/1999 Kawai et al. ..... 399/116
6,055,406 A 4/2000 Kawai et al. ..... 399/360
6,115,567 A 9/2000 Kawai et al. ..... 399/106
6,128,454 A 10/2000 Kawai et al. ..... 399/116
6,131,007 A 10/2000 Yamaguchi et al. ..... 399/256
6,163,665 A 12/2000 Watanabe et al. ..... 399/111
6,175,706 B1 1/2001 Watanabe et al. ..... 399/167
6,226,478 B1 5/2001 Watanabe et al. ..... 399/117
6,240,266 B1 5/2001 Watanabe et al. ..... 399/117
6,275,674 B1 * 8/2001 Sugimoto ..... 399/254
6,336,018 B1 1/2002 Kawai et al. ..... 399/117
6,343,193 B1 1/2002 Matsumoto et al. ..... 399/27
6,349,188 B1 2/2002 Kawai et al. ..... 399/116
6,381,430 B1 4/2002 Yokomori et al. ..... 399/119
6,463,232 B1 10/2002 Kawai et al. ..... 399/111
6,480,687 B1 11/2002 Kawai et al. ..... 399/111
6,496,664 B1 12/2002 Ogata et al. ..... 399/62
6,496,667 B2 12/2002 Shiratori et al. ..... 399/103
6,501,926 B1 12/2002 Watanabe et al. ..... 399/117
6,501,927 B1 12/2002 Watanabe et al. ..... 399/117
6,560,422 B2 5/2003 Kanno et al. ..... 399/106
6,654,566 B1 11/2003 Yamaguchi et al. ..... 399/12

(Continued)

*Primary Examiner*—Hoan Tran
(74) *Attorney, Agent, or Firm*—Fitzpatrick, Cella, Harper & Scinto

(57) ABSTRACT

A developing apparatus develops a latent image formed on an electrophotographic photosensitive member with a developer in an electrophotographic image forming apparatus The device includes a developer accommodating portion and a developer stirring member stirring the developer in the developer accommodating portion. The developer stirring member includes a rotatable member rotatably provided in the developer accommodating portion, first and second stirring rotatable portions provided on the rotatable member, and first and second movable stirring portions movably provided on the first and second stirring rotatable portions, respectively. The radius of rotation of the first and second stirring rotatable portions are different from each other, and a part of a stirring region in which the first stirring rotatable portion and the first movable stirring portion stir the developer and a part of a stirring region in which the second stirring rotatable portion and the second movable stirring portion stirs the developer, overlap.

11 Claims, 11 Drawing Sheets

U.S. PATENT DOCUMENTS

| | | | | |
|---|---|---|---|---|
| 6,735,403 | B2 | 5/2004 | Kanno et al. | 399/103 |
| 6,738,588 | B2 | 5/2004 | Yokomori et al. | 399/111 |
| 6,834,175 | B2 | 12/2004 | Murayama et al. | 399/256 |
| 6,947,686 | B2 | 9/2005 | Kawai et al. | 399/111 |
| 6,957,023 | B2 | 10/2005 | Kinoshita et al. | 399/27 |
| 6,968,142 | B2 | 11/2005 | Arimitsu et al. | 399/114 |
| 6,978,099 | B2 | 12/2005 | Ueno et al. | 399/103 |
| 6,978,100 | B2 | 12/2005 | Yasui et al. | 399/103 |
| 7,016,626 | B2 | 3/2006 | Yokomori et al. | 399/117 |
| 7,027,754 | B2 | 4/2006 | Harada et al. | 399/111 |
| 7,046,942 | B2 | 5/2006 | Arimitsu et al. | 399/114 |
| 2002/0021907 | A1* | 2/2002 | Itoh | 399/27 |
| 2003/0156848 | A1 | 8/2003 | Kawai et al. | 399/27 |
| 2005/0191086 | A1 | 9/2005 | Kawai et al. | 399/110 |
| 2006/0045574 | A1 | 3/2006 | Kawai et al. | 399/254 |
| 2006/0078358 | A1 | 4/2006 | Yasui et al. | 399/284 |

* cited by examiner

DEVELOPING APPARATUS

FIELD OF THE INVENTION AND RELATED ART

The present invention relates to a developing apparatus employed by an electrophotographic image forming apparatus for forming an image on recording medium with the use of one of the electrophotographic image forming methods, a development cartridge removably mountable in the main assembly of an electrophotographic image forming apparatus, and a process cartridge removably mountable in the main assembly of an electrophotographic image forming apparatus.

Here, the term "developing apparatus" means an apparatus having a developing member for developing an electrostatic latent image formed on an electrophotographic photosensitive member. The term "development cartridge" means a cartridge, that is, a unit, in which a developing member is disposed, and which is removably mountable in the main assembly of an electrophotographic image forming apparatus. Further, the term "process cartridge" means a cartridge, that is, a unit, in which an electrophotographic photosensitive member and a developing member are integrally disposed, and which is removably mountable in the main assembly of an electrophotographic image forming apparatus.

As described above, a developing apparatus is for developing an electrostatic latent image formed on an electrophotographic photosensitive member. More concretely, it comprises a development roller as a developing member. As the development roller is rotated, developer is borne on the peripheral surface of the development roller, and is conveyed to an electrophotographic photosensitive member disposed in a manner of opposing the development roller. As a result, the electrostatic latent image on the photosensitive member is developed.

A developing apparatus also comprises a developer container, and a stirring member for stirring the developer stored in the developer container. As the stirring member, a component comprising a rotatable shaft, and a pair coil springs different in their spiral orientation and spirally wrapped around the rotatable shaft has been known (U.S. Patent Publication No. 5,465,140).

Next, a typical developing apparatus in accordance with the prior art will be described as to its structure for stirring developer. This developing apparatus comprises a developer container and a single or plurality of developer stirring members.

The developer container is a hollow container having an opening, which is in one of the side walls of the container. Developer is stored in the hollow of the container. The developer in the developer container is conveyed to the development roller through this opening in the side wall. As the developer reaches the development roller, it adheres to the peripheral surface of the development roller.

The stirring member has a rotational stirring portion, a pair of arm portions, and a pair of supporting portions. The rotational stirring portion is a piece of a rod bent at both ends in the form of a crank. Its length roughly matches the length of the container. The arm portions perpendicularly extend from the ends of the rotational stirring portion, one for one, in the same direction. As for the supporting portions, they extend parallel to the stirring portion 101*a* from the arm portions, one for one, in opposite directions. The supporting portions are inserted in the end walls of the container, being thereby axially supported. Thus, the rotational axis of the stirring member is parallel to the lengthwise direction of the container.

The stirring portion is provided with a pair of springs, which are different in their spiral orientation, and are spirally wrapped around the stirring portion.

The supporting portion is rotated by the force from a motor (unshown) in order to rotate the stirring member in the developer container. As the stirring member is rotated in the container, it conveys the developer in the container toward the development roller through the aforementioned opening However, this setup seems to be problematic in that the body of developer which overlaps with the track of the stirring portion and the tracks of the springs of the stirring portion, as seen from the direction parallel to the axial line of the stirring member, is easily stirred, but the body of developer which does not overlap with the track of the stirring portion and the tracks of the springs of the stirring portion is not easily stirred.

SUMMARY OF THE INVENTION

The present invention is one of the further developments of the above described prior art.

Thus, the primary object of the present invention is to provide a developing apparatus, a development cartridge, and a process cartridge, in which the developer in the developer storage portions is uniformly stirred throughout the developer storage portion.

Another object of the present invention is to provide a developing apparatus, a development cartridge, and a process cartridge, in which the problem that a certain portion of the developer in the developer storage portion deteriorates, does not occur.

According to an aspect of the present invention, there is provided a developing apparatus for developing an electrostatic latent image formed on an electrophotographic photosensitive member with a developer in an electrophotographic image forming apparatus. The developing device comprises: a developer accommodating portion for accommodating the developer to be supplied to the developing member; and a developer stirring member for stirring the developer in the developer accommodating portion. The developer stirring member includes a rotatable member rotatably provided in the developer accommodating portion, a first stirring rotatable portion provided on the rotatable member, a first movable stirring portion movably provided on the first stirring rotatable portion, a second stirring rotatable portion provided on the rotatable member, and a second movable stirring portion movably provided on the second stirring rotatable portion. The radius of rotation of the first stirring rotatable portion and the radius of rotation of the second stirring rotatable portion are different from each other. A part of a stirring region in which the first stirring rotatable portion and the first movable stirring portion stir the developer and a part of a stirring region in which the second stirring rotatable portion and the second movable stirring portion stir the developer, are overlapped.

According to the present invention, the developer in the developer container is uniformly stirred in its entirety.

Further, according to the present invention, the problem that the developer in the developer container is not stirred in its entirety can be prevented. Therefore, the problem that developer deterioration occurs in specific portions of the developer container can be prevented. Therefore, the deterioration of the developer in the developer container can be minimized.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

Figure 1:
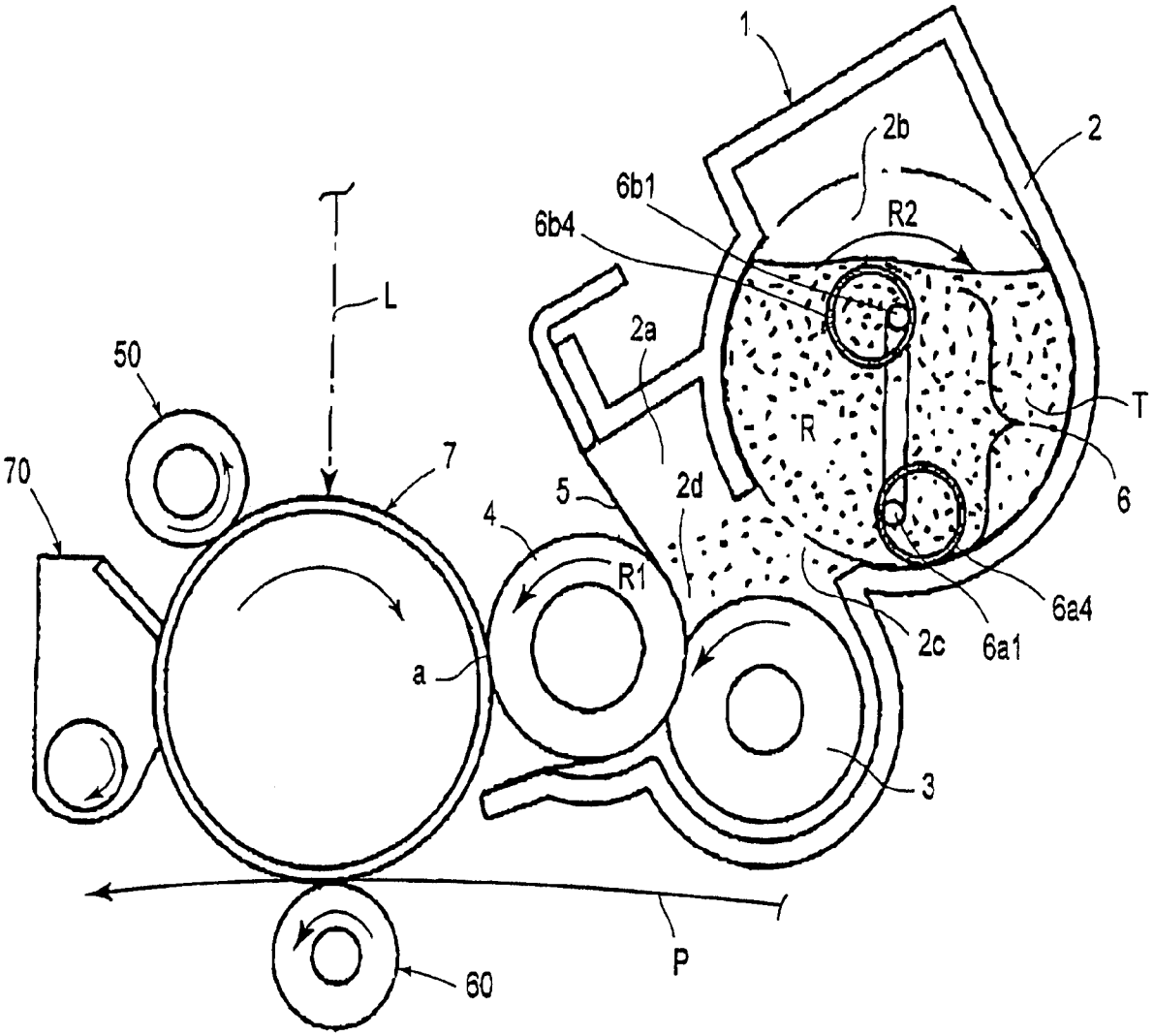
FIG. 1 is a sectional view of the developing apparatus in the first embodiment of the present invention.
Figure 2:
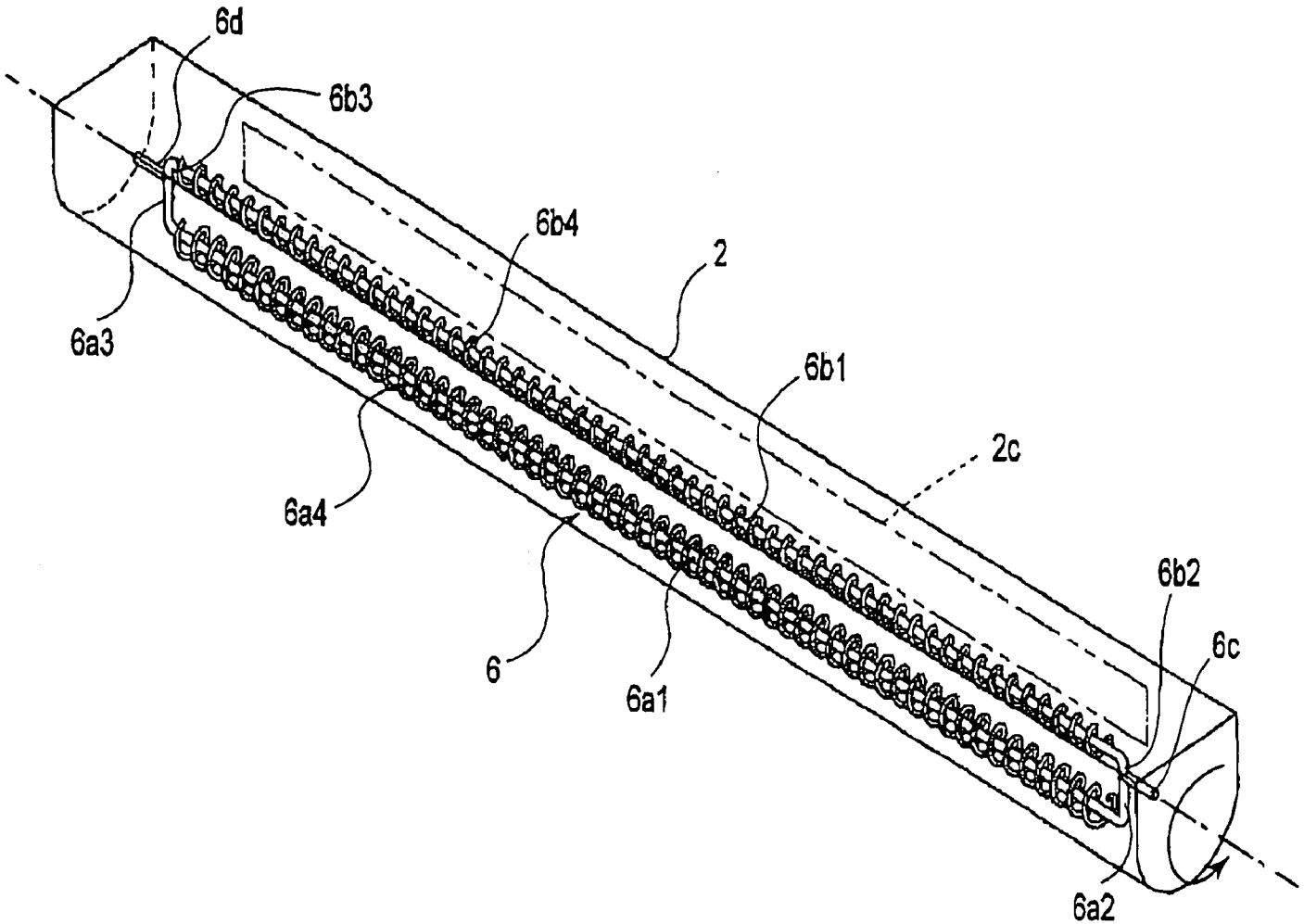
FIG. 2 is an external perspective view of the stirring member.
Figure 3:
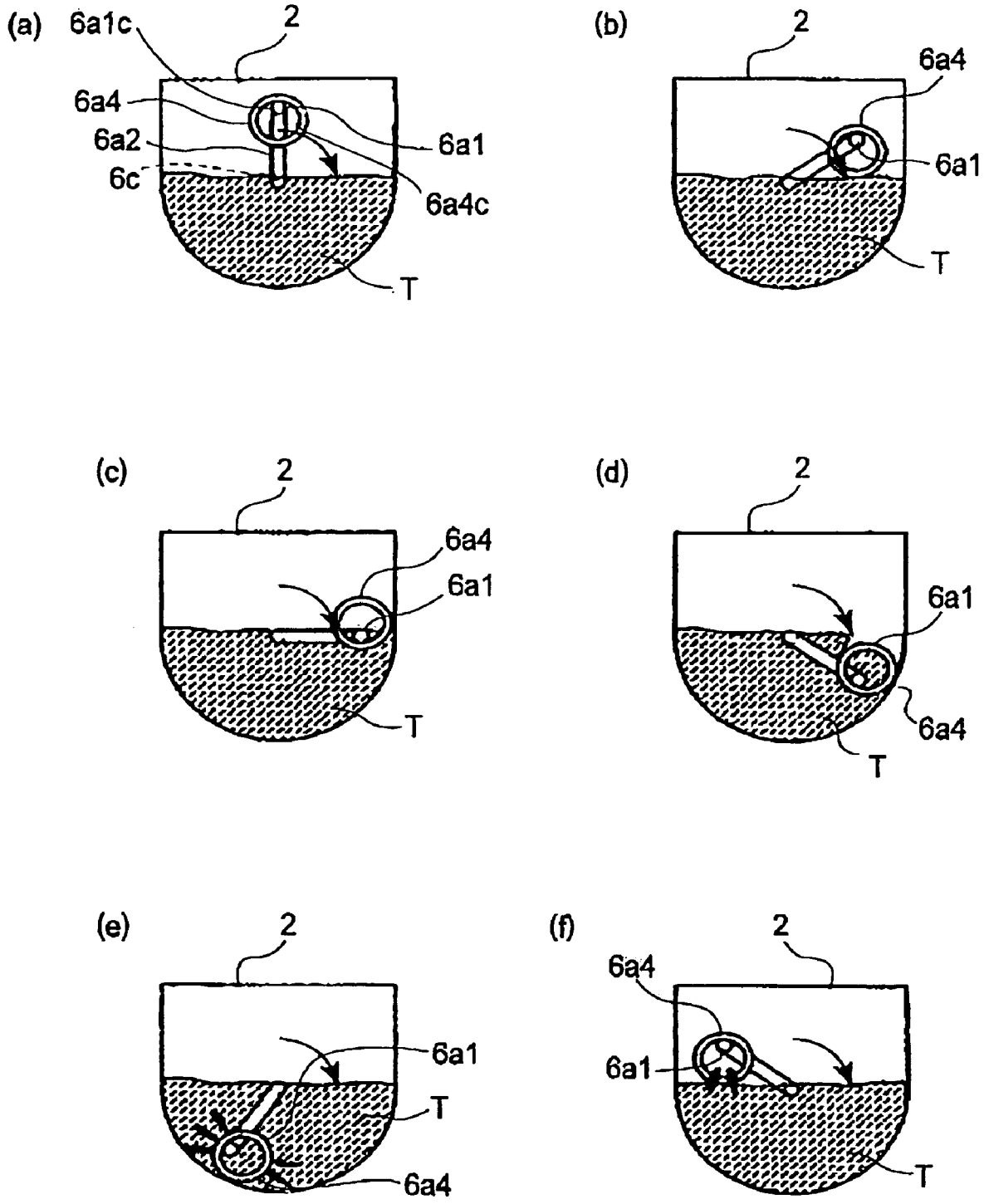
FIGS. 3(*a*)-3(*f*) are schematic sectional views of the developer container, showing how the developer in the developer container is stirred by the developer stirring member, in terms of the direction perpendicular to the lengthwise direction of the developing apparatus.
Figure 4:
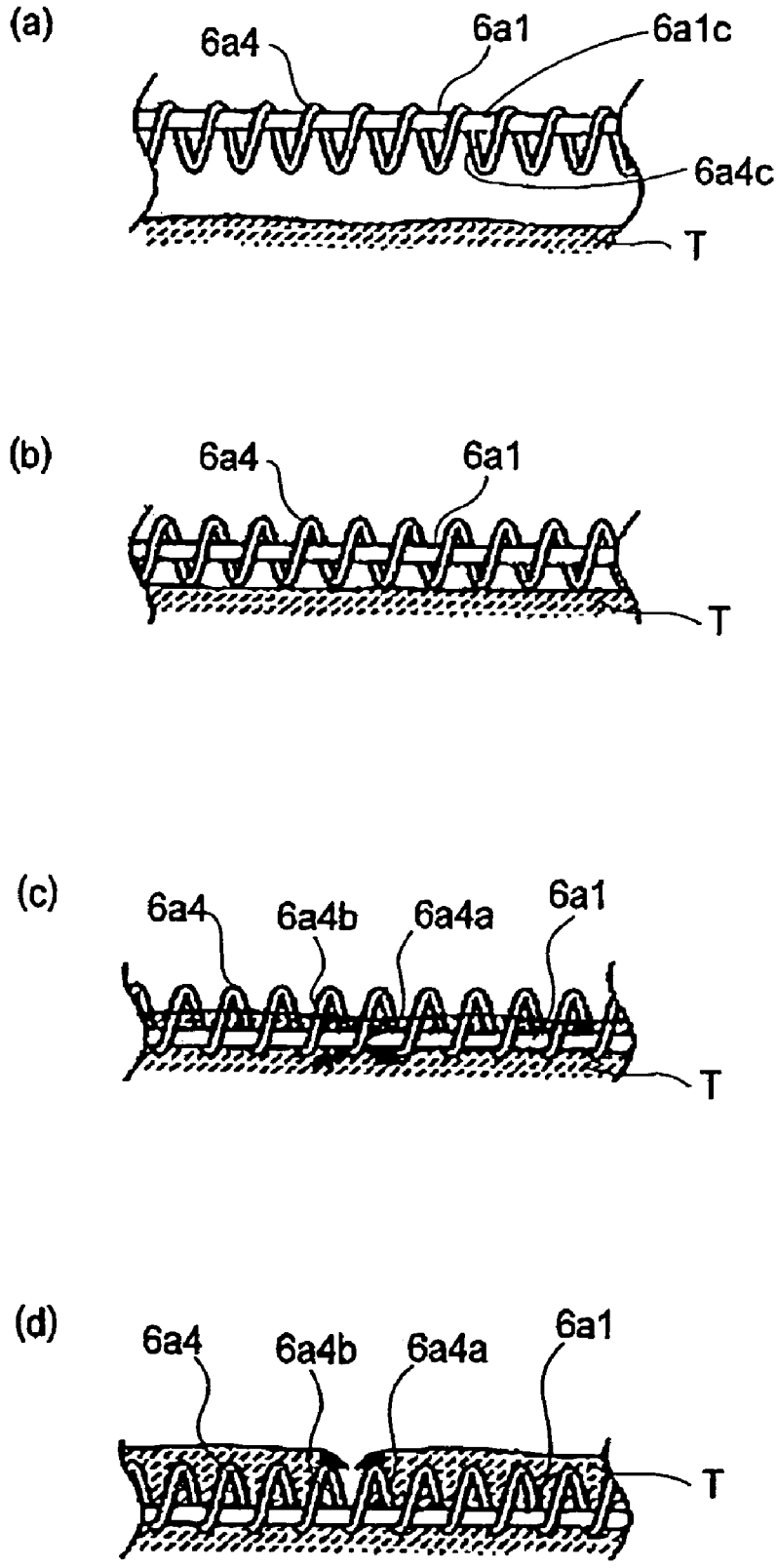
FIGS. 4(*a*)-4(*d*) are schematic sectional views of the developer container, showing how the developer in the developer container is stirred by the developer stirring member, in terms of the direction parallel to the lengthwise direction of the developer container.
Figure 5:
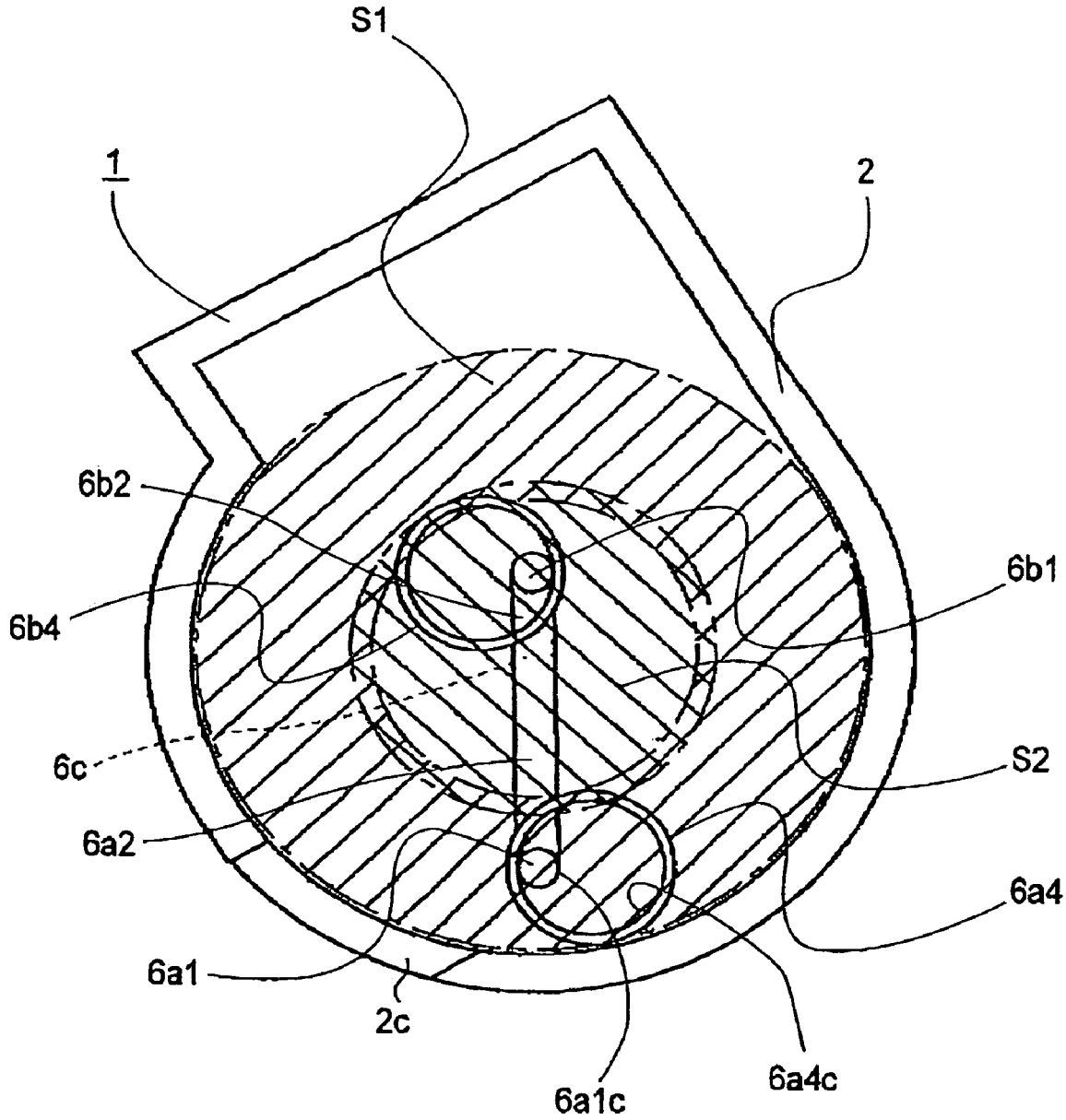
FIG. 5 is a sectional view of the stirring chamber of the developing apparatus, showing how the developer is stirred in the stirring chamber.

Next, the first embodiment of the present invention will be described with reference to the appended drawings. FIG. 1 is a schematic drawing of the electrophotographic image forming apparatus employing the developing apparatus in this embodiment, showing the general structure thereof. FIG. 2 is a perspective view of the developer stirring member in this embodiment. FIG. 3 is a schematic sectional view of the developer container in this embodiment, showing how the developer is stirred by the developer stirring member in the developer container. FIG. 4 is a plan view of the developer stirring chamber, showing how the developer is stirred by the developer stirring member. FIG. 5 is a sectional view of the stirring chamber of the developing apparatus, showing how the developer is stirred in the stirring chamber of the developing apparatus.

Designated by a reference numeral 7 in FIG. 1 is an electrophotographic photosensitive member in the form of a rotational drum (which hereinafter will be referred to as photosensitive drum). This photosensitive drum 7 is rotated by a driving mechanism (unshown) in the clockwise direction indicated by an arrow mark at a predetermined velocity. Designated by a reference numeral 50 is a charge roller as a charging means, which is kept in contact with the photosensitive drum 7. To this charge roller 50, a predetermined charge bias is applied, whereby the peripheral surface of the photosensitive drum 7 is uniformly charged to a predetermined polarity and potential level. The uniformly charged peripheral surface of the photosensitive drum 7 is exposed to a beam of light L, which is projected, while being modulated with image formation data, by an exposing means (unshown). As a result, an electrostatic latent image reflecting the pattern in which the peripheral surface of the photosensitive drum 7 is exposed is formed on the peripheral surface of the photosensitive drum 7. The electrostatic latent image is developed by a developing apparatus 1 which uses developer. Meanwhile, a recording medium P (for example, recording paper, OHP sheet, etc.) is delivered from a recording medium feeding and conveying mechanism (unshown) to the transfer portion, that is, the nip between the photosensitive drum 7 and a transfer roller 60 as a transferring means, and is conveyed through the transfer portion while remaining pinched between the peripheral surfaces of the photosensitive drum 7 and transfer roller 6. While the recording medium P is conveyed through the transfer portion, a predetermined transfer bias is applied to the transfer roller 60, whereby the infinite number of portions of the image being continually formed of the developer on the photosensitive drum 7 are continually transferred onto the recording medium P as they are formed. After being conveyed through the transfer portion, the recording medium P is separated from the peripheral surface 7, and is sent to a fixing apparatus, by which the image formed of the developer (which hereinafter will be referred to simply as developer image) is fixed to the surface of the recording medium P. A cleaning apparatus 70 removes the developer remaining on the peripheral surface of the photosensitive drum 7 after the separation of the recording medium P from the photosensitive drum 7.

Regarding the developing apparatus 1 in this embodiment, its development roller 4 is disposed in contact with the photosensitive drum 7. It employs the so-called contact developing method, in which the layer of developer T on the peripheral surface of the development roller 4 is placed in contact with the peripheral surface of the photosensitive drum 7 to develop a latent image on the peripheral surface of the photosensitive drum 7.

The developing apparatus 1 comprises: the development roller 4; a supply roller 3 as a developer supplying means; a blade 5 as a means for regulating developer; and a developer stirring member 6 as a developer stirring means; etc. The development roller 4 conveys the developer T by bearing the developer T on its peripheral surface. Thus, as the development roller 4 is rotated, the developer T is placed in contact with the peripheral surface of the photosensitive drum 7, developing thereby the electrostatic latent image on the peripheral surface of the photosensitive drum 7. The supply roller 3 supplies the development roller 4 with the developer T. The blade 5 regulates the amount of the developer T that is adhered to the peripheral surface of the development roller 4. Thus, as a given area of the peripheral surface of the development roller 4 is moved past the development blade 5, a thin layer of developer T is formed on the given area. The stirring member 6 is rotated to stir the developer T supplied by a developer supplying means (unshown) and the developer T in the developing apparatus 1 to mix the former into the latter.

The developer T used in this embodiment is a nonmagnetic single-component developer (toner) which is inherently chargeable to the negative polarity.

The developer T is stored in the developer container 2 of the developing apparatus 1. The developer container 2 has a development chamber 2, a stirring chamber 2*b* as a developer storage portion, and an opening 2*c*. In the development chamber 2*a*, the abovementioned development roller 4, supply roller 3, and blade 5 are disposed. In the stirring chamber 2*b*, the developer T to be used for developing an electrostatic latent image is stored. Also in the stirring chamber 2*b*, the stirring member 6 is disposed. The opening 2*c* is for allowing the developer T to be moved from the stirring chamber 2*b* to the development chamber 2*a*; the developer T in the stirring chamber 2*b* is conveyed to the development chamber 2*a* though the opening 2*c*.

The developer container 2 is also provided with an opening 2*d*, which is in the wall of the container 2 located next to the photosensitive drum 7. The development roller 4 is partially exposed toward the photosensitive drum 7 through the opening 2*d*. The development roller 4 is supported by the developer container 2 so that it can be rotated in the direction indicated by an arrow mark R1. Further, the development roller 4 has an elastic portion, which constitutes the peripheral layer of the development roller 4, and is kept in contact with the photosensitive drum 7 so that a predetermined amount of contact pressure is maintained between the development roller 4 and photosensitive drum 7. The developer container 2 is also provided with a developer scatter prevention sheet 8, which is extended from one of the lengthwise ends of the opening 2*d* to the other to prevent the developer T from scattering from the bottom side of the development roller 4.

The stirring member 6 is disposed on the opposite side of the opening 2*d* from the opening 2*c* and also, higher than the opening 2*c*. It is rotatable in the direction indicated by an arrow mark R2. Also in the developer container 2, a stirring region R is provided in which a fresh supply of developer T is mixed into the body of developer T in the developer container 2 as it is supplied from outside the developer container 2 (from aforementioned developer supplying means (unshown) for example).

Below the stirring region R, the supply roller 3 for supplying the development roller 4 with the developer T or recovering the developer T from the development roller 4 is disposed in contact with the development roller 4. The supply roller 3 is an elastic roller formed of foamed elastic substance. It is rotated in the direction opposite to the rotational direction of the development roller 4.

The developer T is thoroughly stirred in the stirring region R by the stirring member 6. Then, the developer T moves past the opening 2*c* primarily due to its own weight, and is conveyed by the supply roller 3 to the development roller 4.

To the developer container 2, the blade 5 as an elastic regulating member is attached so that it presses upon the peripheral surface of the development roller 4. The blade 5 is made up of a piece of thin elastic metal, and a layer of electrically nonconductive substance placed on the metallic plate, on the surface which faces the development roller 4. The developer T on the development roller 4 is rubbed against the peripheral surface of the development roller 4 and the blade 5, as the development roller 4 is rotated. As a result, the developer T is given electrical charge by the friction between the developer T and the development roller 4, and the friction between the blade 5 and developer T, by the amount sufficient for development.

As the development roller 4 is further rotated, the developer T on the peripheral surface of the development roller 4 is conveyed to the development region a (development nip) in which the photosensitive drum 7 and development roller 4 are in contact with each other. In the development region a, the developer T comes into contact with the photosensitive drum 7. To the development roller 4, an electrical power source (unshown) is connected to form an electric field (developmental electric field) between the photosensitive drum 7 and the development roller 4. In the development region a, therefore, the developer T on the peripheral surface of the development roller 4 is transferred by the developmental electric field onto the peripheral surface of the photosensitive drum 7. As a result, a visible image is formed of the developer T, in the pattern of the electrostatic latent image on the photosensitive drum 7, on the photosensitive drum 7; in other words, the electrostatic latent image is developed into a visible image.

The residual developer, that is, the developer T which was conveyed to the development nip a, but, did not contribute to development, that is, the developer that remains on the peripheral surface of the development roller 4, is stripped from the peripheral surface of the development roller 4 by the friction between the peripheral surfaces of the development roller 4 and the supply roller 3. A part of the stripped developer T is supplied to the development roller 4 by the supply roller 3, along with the developer T freshly supplied to the supply roller 3, and the rest is returned to the developer container 2.

In this embodiment, the supply roller 3 is given two functions: the function of the developer supplying means and the function of the developer recovering means. This setup is not intended to limit the present invention in applicability. In other words, the developer supplying means and developer recovering means may be set up as means independent from each other.

Referring to FIG. 2, the stirring member 6 is made up of a pair of rotational stirring portions 6*a*1 and 6*b*1, and a plurality of arm portions 6*a*2, 6*a*3, 6*b*2, and 6*b*3. The stirring portions 6*a*1 and 6*b*1 are the center portions of a pair of rods, one for one, perpendicularly bent at a point in the adjacencies of both ends. The stirring portions 6*a*1 and 6*b*1 roughly match in length the developer container 2, being thereby enabled to stir the developer T across the entire lengthwise range of the developer container 2. The arm portions 6*a*2 and 6*a*3 are the portions of the stirring member 6, which perpendicularly extend from the lengthwise ends of the stirring portion 6*a*1, one for one, in the same direction, and the arm portions 6*b*2 and 6*b*3 are the portions of the stirring member 6, which perpendicularly extend from the lengthwise ends of the stirring portion 6*b*1 one for one in the same direction.

The arm portions 6*a*2 and 6*a*3 are virtually the same in length, and the arm portions 6*b*2 and 6*b*3 are virtually the same in length. The arm portions 6*a*3 and 6*b*3 are longer than the arm portions 6*a*2 and 6*b*2, respectively. Further, the arm 6*a*2 is connected to the arm portion 6*b*2 at one of the lengthwise ends of the stirring portion 6*a*1 (6*b*1), and the arm 6*a*3 is connected to the arm portion 6*b*3 at the other end of the stirring portion 6*a*1 (6*b*1).

The stirring member 6 has a pair of supporting portions 6*c* and 6*d*, which extend outward of the developer container 2 from the joint of the arm portions 6*a*2 and 6*b*2, and the joint of the arm portions 6*a*3 and 6*b*3, respectively, in the direction parallel to the stirring portions 6*a*1 and 6*b*1. The stirring member 6 is rotatably supported by the end walls of the developer container 2, one for one, by the supporting portions 6*c* and 6*d*. The rotational axis of the stirring member 6 (which coincides with rotational axes of supporting portion 6*c* and 6*d*) is parallel to the lengthwise direction of the developer container 2. As rotational driving force is transmitted to the supporting portion 6*c* and/or 6*d* by a driving mechanism (unshown), the stirring member 6 is rotated about the abovementioned rotational axis (which coincides with rotational axes of supporting portions 6*c* and 6*d*).

The stirring portions 6*a*1 and 6*b*1 are externally fitted with a pair of mobile stirring portions 6*a*4 and 6*b*4, respectively, which are in the form of a coil; the pair of stirring portions 6*a*4 and 6*b*4 are loosely fitted around the stirring portions 6*a*1 and 6*b*1, being enabled to move relative to the stirring portions 6*a*1 and 6*b*1, respectively. The movement of the mobile stirring portions 6*a*4 and 6*b*4 in the direction parallel to the lengthwise direction of the developer container 2 is regulated by the supporting portions 6*c* and 6*d* (supporting portions 6*c* and 6*d* constitute stoppers for the mobile stirring portions 6*c* and 6*d*). In other words, in this embodiment, the mobile stirring portions 6*a*4 and 6*b*4 are loosely fitted around the rotational stirring portions 6*a*1 and 6*b*1 so that the mobile stirring portions 6*a*4 and 6*b*4 are allowed to move relative to the rotational stirring portions 6*a*1 and 6*b*1 in the directions parallel to their axial and radius directions, as well as circumferential directions, of the mobile stirring portions 6*a*4 and 6*b*4, respectively. This setup, however, is not intended to limit the present invention in applicability. That is, the former may be fitted around the latter so that the former are allowed to move relative to the latter, only in one direction among the axial, radius direction, and circumferential directions of the former, or only in two out of the abovementioned three directions. Incidentally, the internal diameters of the mobile stirring portions 6*a*4 and 6*b*4 are greater than the external diameters of the rotational stirring portions 6*a*1 and 6*b*1, respectively. In this embodiment, the external diameters of the rotational stirring portions 6*a*1 and 6*b*1 are in the range of 1 mm-7 mm, whereas the internal diameters of the mobile stirring portions 6*a*4 and 6*b*4 are in the range of 1.5-15 mm, allowing thereby the mobile stirring portions 6*a*4 and 6*b*4 to move relative to the rotational stirring portion 6*a*1 and 6*b*1. The mobile stirring portions 6*a*4 and 6*b*4 in the form of a coil can be made by spirally winding a piece of wire, the diameter of which is in the range of 0.3-3 mm, so that the resultant coil will be 1-10 mm in pitch, and 1.5-15 mm in diameter.

Next, the operation of the developing apparatus structured as described above will be described. As the stirring member 6 is rotated, both the rotational stirring portions 6*a*1 and 6*b*1, which are different in rotational radius (distance from axial line), are rotated about the axial lines of the supporting portions 6*c* and 6*d*, stirring thereby the developer T in the developer container 2.

As the stirring member 6 is rotated, not only is the developer T, which is inside the tracks of the rotational stirring portions 6*a*1 and 6*b*1 as seen from a direction parallel to the axial line of the stirring member 6, stirred, but also, the developer T, which is inside the tracks of the mobile stirring portions 6*a*4 and 6*b*4 as seen from a direction parallel to the axial line of the stirring member 6, is stirred. Referring to FIG. 5, as seen from the direction parallel to the axial line of the stirring member 6, a region S1, across the entirety of which the developer T is stirred by the rotational stirring portion 6*a*1 and mobile stirring portion 6*a*4, and a region S2, across the entirety of which the developer T is stirred by the rotational stirring portion 6*b*1 and mobile stirring portion 6*b*4, partially overlap with each other, across the entire rotational range of the stirring member 6. Further, the regions S1 and S2 partially overlap with each others across virtually the entire range of the developer container 2 in terms of the direction parallel to the lengthwise direction of the developer container 2. In other words, with the employment of this setup, not only will there be no region, in the internal space of the developer container 2, in which the developer T is not stirred by the stirring member 6, but also, the developer T is traded between the regions S1 and S2. Incidentally, the developing apparatus 1 may be structured so that the regions S1 and S2 perfectly overlap with each other. However, structuring the developing apparatus 1 so that the regions S1 and S2 partially overlap with each other, causes the developer T to be traded between the two regions S1 and S2, and also, widens the overall ranges (S1+S2), making it thereby possible to uniformly stir the developer T by the rotation of the stirring member 6.

At this time, how the developer T is stirred by the mobile stirring portions 6*a*4 and 6*b*4 as the rotational stirring portions 6*a*1 and 6*b*1 are rotated about the axial line of the supporting portion 6*a* (6*b*), will be described in detail with reference to FIGS. 3(*a*)-3(*f*).

FIG. 3(*a*) shows the state of the developing apparatus 1 immediately after the mounting of the developing apparatus 1 into the main assembly 10 of an image forming apparatus. In this state, that is, the state in which the rotational stirring portion 6*a*1 is at the highest point of its track, in other words, the arm portions 6*a*2 and 6*a*3 are vertically positioned (positioned at twelve o'clock) above the axial line of the stirring member 6, the mobile stirring portion 6*a*4 is in contact with the circumferential surface 6*a*1*c* of the rotational stirring member 6*a*1, by the internal surface, due to gravity.

FIG. 3(*b*) shows the state of the developer container 2, in which the stirring member 6 has rotated about the supporting portions 6*c* and 6*d* in the clockwise direction, with the circumferential surface 6*a*4*d* of the mobile stirring portion 6*a*4 having come into contact with the top surface of the body of developer T. As the stirring member 6 in the state shown in FIG. 3(*b*) is further rotated in the clockwise direction, it is subjected to the reactive force from the top surface of the body of developer T, being thereby prevented from immediately digging into the body of developer T. As a result, the mobile stirring portion 6*a*4 temporarily remains on the top surface of the body of developer T, causing the contact between the rotational stirring portion 6*a*1 and mobile stirring portion 6*a*4 to be temporarily lost.

FIG. 3(*c*) shows the state of the developer container 2, in which the stirring member 6 has been further rotated, with the circumferential surface 6*a*1*c* of the stirring portion 6*a*1 having been lowered to the level at which it is virtually in contact with the top surface of the body of developer T. As a result, the surface 6*a*1*c* of the rotational stirring portion 6*a*1 has again come into contact with the internal surface of the mobile stirring portion 6*a*4. As the stirring member 6 in this state is further rotated in the clockwise direction, the mobile stirring portion 6*a*4 is forced to dig into the body of developer T while collecting and retaining in its hollow, the developer T in the adjacencies of the top surface of the body of developer T.

FIG. 3(*d*) shows the state of the developer container 2, in which the developer T is about to flow into the void created by the removal of the developer T in the adjacencies of the top surface of the body of developer T by the rotational stirring portion 6*a*1, from the areas surrounding the void, because of the force which acts to flatten the surface of the body of developer T.

FIG. 3(*e*) shows the state of the developer container 2, in which the rotational stirring portion 6*a*1 and the mobile stirring portion 6*a*4 are being moved through the body of developer T in the developer container 2. While the rotational stirring portion 6*a*1 and mobile stirring portion 6*a*4 are moved through the body of p T, they, in particular, the mobile stirring portion 6*a*4, are subjected to the reactive force from the developer T, and therefore, the contact point between the rotational stirring portion 6*a*1 and the mobile stirring portion 6*a*4 shifts in position in the clockwise direction, relative to both a given point of the rotational stirring portion 6*a*1 and a given point of the mobile stirring portion 6*a*4. With the shift in position of the contact point between the rotational stirring portion 6*a*1 and mobile stirring portion 6*a*4, the developer T in the hollow of the mobile stirring portion 6*a*4 is continuously traded with the developer T outside the boundary of the mobile stirring portion 6*a*4, as indicated by a plurality of arrow marks in the drawing.

FIG. 3(*f*) shows the state of the developer container 2, in which the rotational stirring portion 6*a*1 and mobile stirring portion 6*a*4 have just come out of the body of developer T in the developer container 2. As they come out of the body of developer T, the developer T within the hollow of the mobile stirring portion 6*a*4 is falls out of the hollow as shown by arrow marks in the drawing.

Next, referring to FIGS. 4(*a*)-4(*d*), the stirring of the developer T in terms of the direction parallel to the lengthwise direction of the stirring member 6 will be described in detail.

FIG. 4(*a*) shows the state of the developer container 2, immediately after the mounting of the developing apparatus 1 into the main assembly 10 of the image forming apparatus. In this state, that is, the state in which the rotational stirring portion 6*a*1 is at the highest point of its track, in other words, the arm portions 6*a*2 and 6*a*3 are vertically positioned (positioned at twelve o'clock) above the axial line of the stirring member 6, the mobile stirring portions 6*a*4 is in contact with the circumferential surface 6*a*1*c* of the rotational stirring member 6, by the internal surface, due to gravity FIG. 4(*b*) shows the state of the developer container 2, in which the stirring member 6 has been rotated about the supporting portions 6*c* and 6*d* in the clockwise direction, with the circumferential surface 6*a*4*d* of the mobile stirring portion 6*a*4 having come into contact with the top surface of the body of developer T. As the stirring member 6 in the state shown in FIG. 4(*b*) is further rotated in the clockwise direction, it is subjected to the reactive force from the top surface of the body of developer T, being thereby prevented from immediately digging into the body of developer T. As a result, the mobile stirring portion 6*a*4 temporarily remains on the top surface of the developer powder T, causing the contact between the rotational stirring portion 6*a*1 and mobile stirring portion 6*a*4 to be temporarily lost.

FIG. 4(*c*) shows the state of the developer container 2, in which the stirring member 6 has been further rotated, with the circumferential surface 6*a*1*c* of the stirring portion 6*a*1 having been lowered to the level at which it is virtually in contact with the top surface of the body of developer T. As a result, the surface 6*a*1*c* of the rotational stirring portion 6*a*1 has come again into contact with the internal surface of the mobile stirring portion 6*a*4. As the stirring member 6 in this state is further rotated in the clockwise direction, the mobile stirring portion 6*a*4 is forced to dig into the body of developer T, with the tilted surface 6*a*4*a* of the mobile stirring portion 6*a*4 pressing the top surface of the body of developer T diagonally downward toward the left. In the drawing, the tilted surface 6*a*4*a* of the mobile stirring portion 6*a*4 is on the viewer side of the drawing, whereas the tilted surface 6*a*4*b* of the mobile stirring portion 6*a*4 is on the opposite side of the drawing from the viewer of the drawing.

FIG. 4(*d*) shows the state of the developer container 2, in which the developer T is about to flow into the void created by the removal of the developer T in the adjacencies of the top surface of the body of developer T by the abovementioned tilted surfaces 6*a*4*a* and 6*a*4*b*, because of the force which acts to flatten the surface of the body of developer T.

The above described flow of the developer T into the void in the direction parallel to the lengthwise direction of the developer container 2 continues as long as the rotational stirring portion 6*a*1 and the mobile stirring portion 6*a*4 are being rotationally moved in the body of developer T in the developer container 2.

Although what was described above was the stirring of the developer T by the mobile stirring portion 6*a*4, which occurs as the rotational stirring portion 6*a*1 greater in the track diameter than the rotational stirring portion 6*b*1 is moved, the developer T in the developer container 2 is also stirred by the mobile stirring portion 6*b*4 as the rotational stirring portion 6*b*1 smaller in the track diameter than the rotational stirring portion 6*a*1 is moved.

As described above, in this embodiment, the stirring sequence comprising the intake and exhaust of the developer T in terms of the direction perpendicular to the lengthwise direction of the developer container 2, and the flowing of the developer T in the direction parallel to the lengthwise direction of the developer container 2 into the voids created by the rotation of the stirring member 6 is continuously repeated as the stirring member 6 is rotated. As a result, the developer T in the developer container 2 is uniformly stirred in its entirety. Also in this embodiment, the developer T within the track of the rotational stirring portion 6*a*1 as seen from the direction parallel to the rotational axis of the rotational stirring portion 6*a*1, is stirred, while being circulated on the macro scale by the rotational movement of the rotational stirring portion 6*a*1. Further, by the movement of the mobile stirring portion 6*a*4 relative to the rotational stirring portion 6*a*1, the developer T in the track of the mobile stirring portion 6*a*4 is stirred while being circulated on the micro scale Therefore, this embodiment makes it possible to uniformly stir the developer T in its entirety in the developer container 2 even if the developer container 2 is substantial in size. Moreover, the developer T in the developer container 2 can be uniformly stirred in its entirety even if the developer container 2 is small in capacity. Incidentally, in this embodiment, the capacity of the developer container 2 is roughly 420 $cm^3$. Further, this embodiment makes it possible to swiftly and uniformly stir the developer T in the developer container 2, even if the developer T in the developer container 2 is highly fluid like nonmagnetic single-component developer, and the developing apparatus employs a developer supply system which requires the developer in the developer container 2 to be swiftly and uniformly stirred.

Embodiment 2

Figure 6:
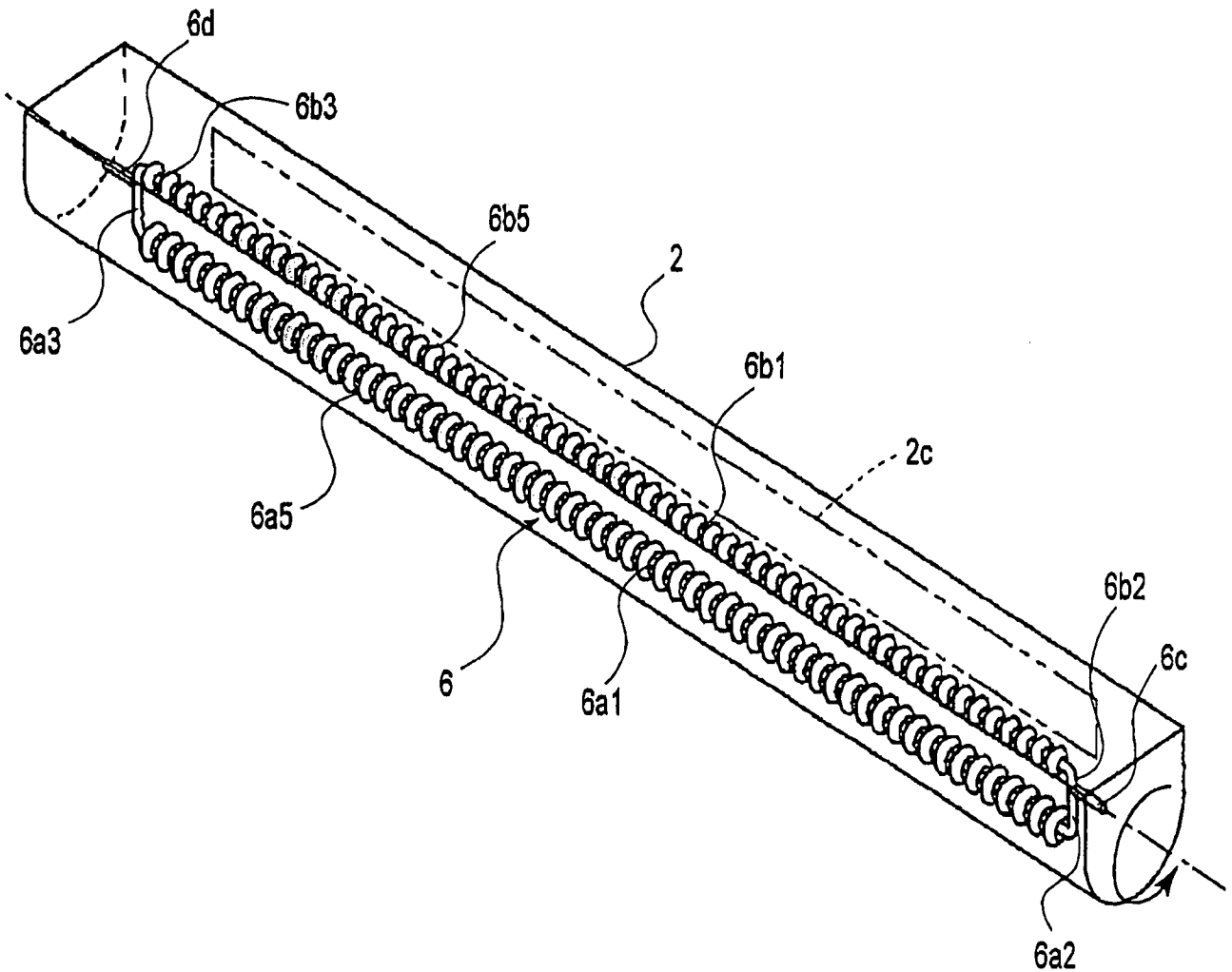
FIG. 6 is an external perspective view of the developer stirring member in the second embodiment of the present invention.

Next, the second embodiment of the present invention will be described. FIG. 6 is a perspective view of the developer stirring member in this embodiment. The structural features of the developer stirring member in this embodiment, which are identical to those shown in FIG. 2 will not be described here.

In this embodiment, the rotational stirring portions 6*a*1 and 6*b*1 of the stirring member 6 are externally fitted with a plurality of mobile stirring portions 6*a*5 and 6*b*5 in the form of a circular ring, the internal diameters of which are greater than the external diameters of the rotational stirring portions 6*a*1 and 6*b*1, respectively. In other words, in this embodiment, the mobile stirring portions 6*a*5 and 6*b*5 are allowed to move relative to the rotational stirring portions 6*a*1 and 6*b*1, respectively, in their radius directions.

Figure 7:
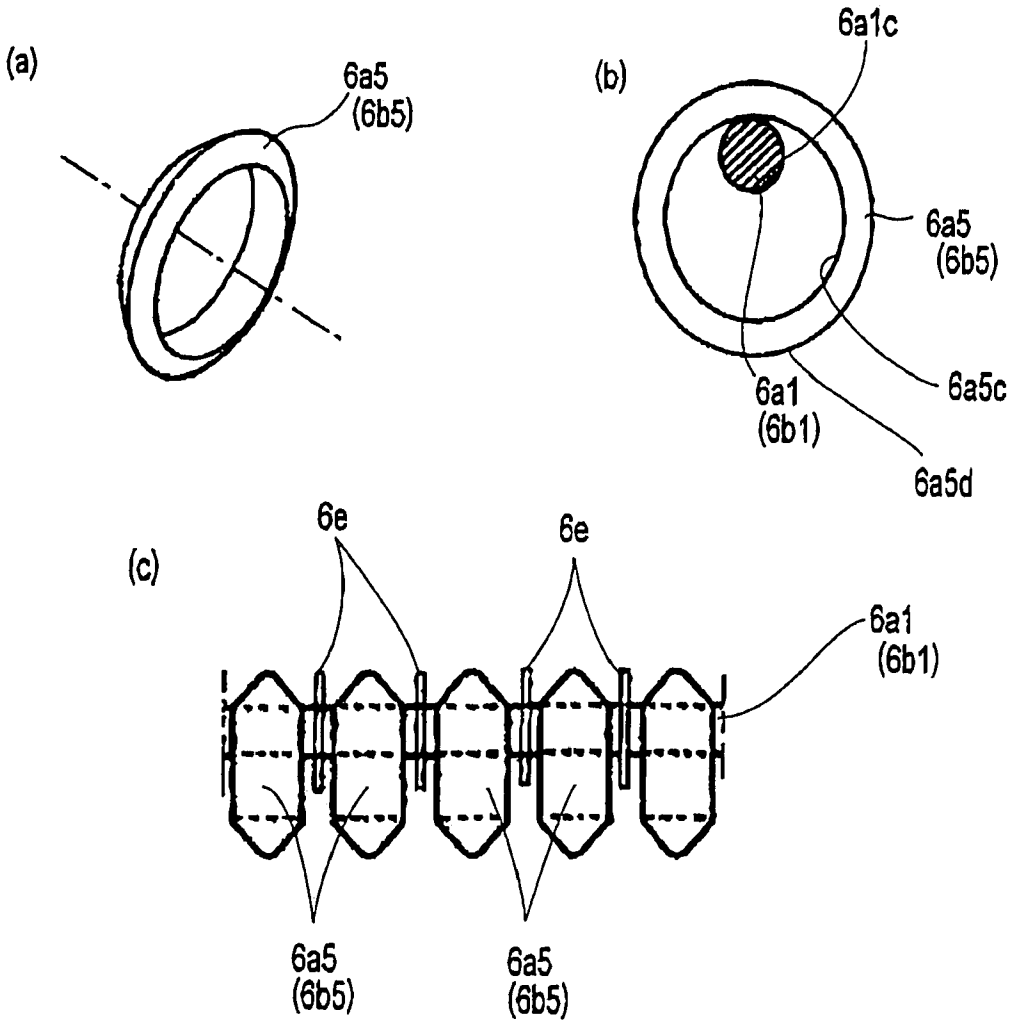
FIG. 7 is a schematic drawing showing the mobile stirring portions.

FIG. 7(*a*) is an enlarged perspective view of one of the plurality of mobile stirring portions 6*a*5 (6*b*5), and FIG. 7(*b*) is a sectional view of the rotational stirring portion 6*a*1 (6*b*1) and mobile stirring portion 6*a*5 (6*b*5) fitted around the rotational stirring portion 6*a*1 (6*b*1). If necessary, the stirring member 6 may be provided with a plurality of partitioning stoppers 6*e*, that is, portions for limiting the distance the mobile stirring portions 6*a*5 (6*b*5) are allowed to move in the lengthwise direction of the rotational stirring portion 6*a*1 (6*b*1); which are solidly attached to the rotational stirring portion 6*a*1 (6*b*1), one for each interval of the plurality of mobile stirring portions 6*a*5 (6*b*5), as shown in FIG. 7(*c*), in order to prevent the mobile stirring portions 6*a*5 (6*b*5) from excessively shifting in the lengthwise direction of the stirring member 6. Obviously, the stirring member 6 may be provided with a plurality of partitioning stoppers 6*e*, which are solidly attached to the rotational stirring portion 6*a*1 (6*b*1), one for every predetermined number of intervals of the mobile stirring portions 6*a*5 (6*b*5).

The intake and exhaust of the developer T by the stirring member 6 in this embodiment, in the direction perpendicular to the lengthwise direction of the developer container 2, are the same as those shown in FIG. 3, and therefore, will not be described here.

Next, referring to FIGS. 8(*a*)-8(*d*), the stirring of the developer T by the stirring member 6 in terms of the lengthwise direction of the stirring member 6 will be described in detail.

Figure 8:
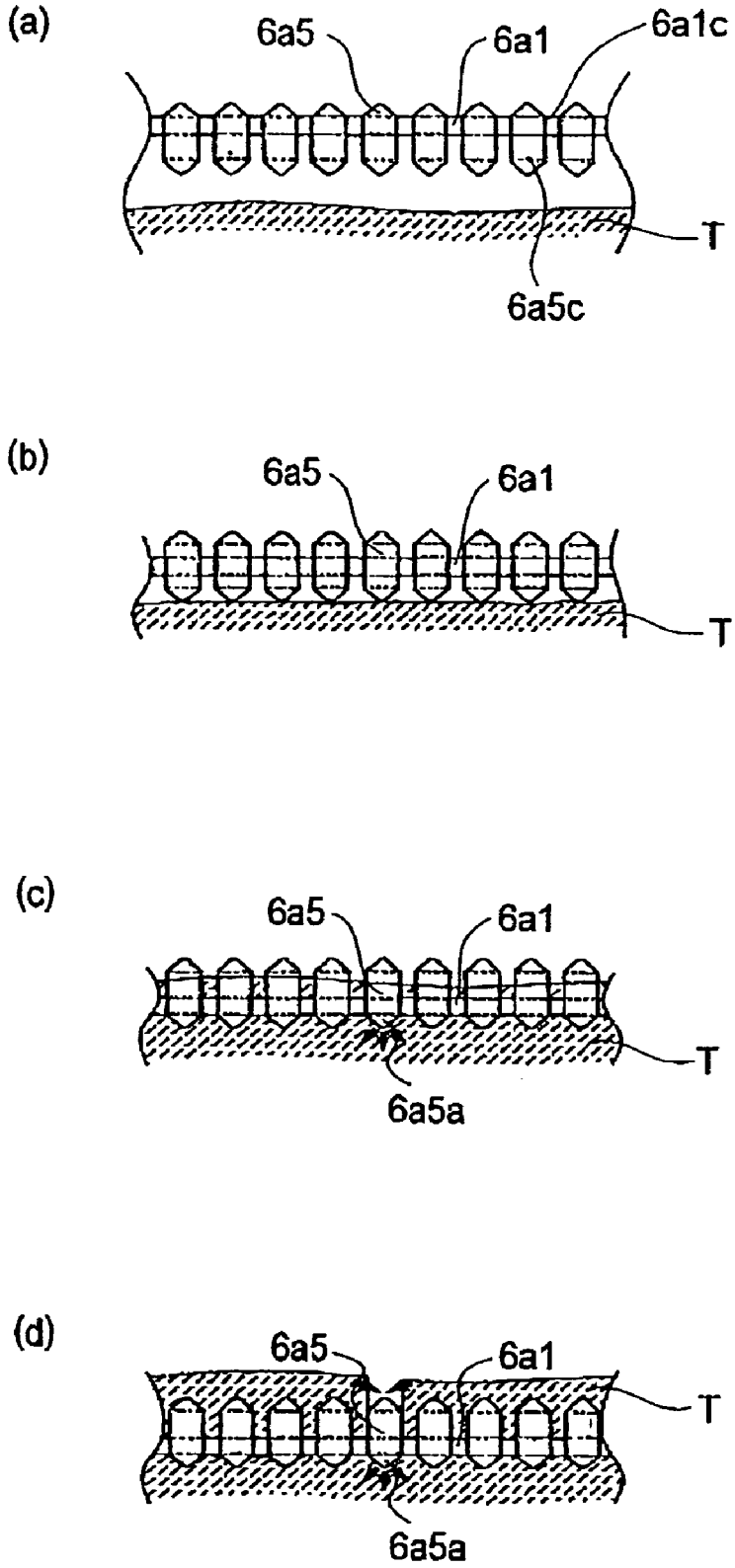
FIG. 8 is a schematic plan view of the developer stirring member, showing how the developer is stirred by the developer stirring member, in terms of the direction parallel to the lengthwise direction of the stirring member, in the stirring chamber.

FIG. 8(*a*) shows the state of the developer container 2, in which the rotational stirring portion 6*a*1 is at the highest point of its track, in other words, the arm portions 6*a*2 and 6*a*3 are vertically positioned (positioned at twelve o'clock) above the axial line of the stirring member 6, and the internal surface 6*a*5*c* of the mobile stirring portion 6*a*5 has come into contact with the circumferential surface 6*a*1*c* of the rotational stirring member 6*a*1, due to gravity.

FIG. 8(*b*) shows the state of the developer container 2, in which the stirring member 6 has rotated about the supporting portions 6*c* and 6*d* in the clockwise direction, with the outward surface 6*a*5*a* of the mobile stirring portion 6*a*5 having come into contact with the top surface of the body of developer T. As the stirring member 6 in the state shown in FIG. 8(*b*) is further rotated in the clockwise direction, the mobile stirring portion 6*a*5 is subjected to the reactive force from the top surface of the body of developer T, being thereby prevented from immediately digging into the body of developer T. As a result, the mobile stirring portion 6*a*5 temporarily remains on the top surface of the developer powder T, causing the contact between the rotational stirring portion 6*a*1 and mobile stirring portion 6*a*5 to be temporarily lost.

FIG. 8(*c*) shows the state of the developer container 2, in which the stirring member 6 has been further rotated, with the circumferential surface 6*a*1*c* of the stirring portion 6*a*1 having been lowered to the level at which it is virtually in contact with the top surface of the body of developer T. As a result, the surface 6*a*1*c* of the rotational stirring portion 6*a*1 has come again into contact with the internal surface of the mobile stirring portion 6*a*5. As the stirring member 6 in this state is further rotated, the mobile stirring portion 6*a*5 is forced to dig into the body of developer T while the peripheral surface 6*a*5*a* of the mobile stirring portion 6*a*5 pushes down the top surface of the body of developer T in the direction parallel to the normal lines of the angled outward surfaces of the mobile stirring portions 6*a*5.

FIG. 8(*d*) shows the state of the developer container 2, in which the developer T is about to flow into the void created by the removal of the developer T in the adjacencies of the top surface of the body of developer T by the outward surface 6*a*5*a* of the movable stirring portion 6*a*5, from the areas surrounding the void, in the direction indicated by arrow marks, because of the force which acts to flatten the surface of the body of developer T.

The above described flow of the developer T into the void in the direction parallel to the lengthwise direction of the developer container 2 (direction parallel to rotational axis of stirring member 6) continues as long as the rotational stirring portion 6*a*1 and mobile stirring portions 6*a*5 are moving in the body of developer T in the developer container 2.

As described above, in this embodiment, the stirring sequence comprising the intake and exhaust of the developer T in terms of the direction perpendicular to the lengthwise direction of the developer container 2, and the flowing of the developer T in the direction parallel to the lengthwise direction of the developer container 2 is continuously repeated as the stirring member 6 is rotated. As a result, the developer T in the developer container 2 is uniformly stirred in its entirety.

Embodiment 3

Figure 9:
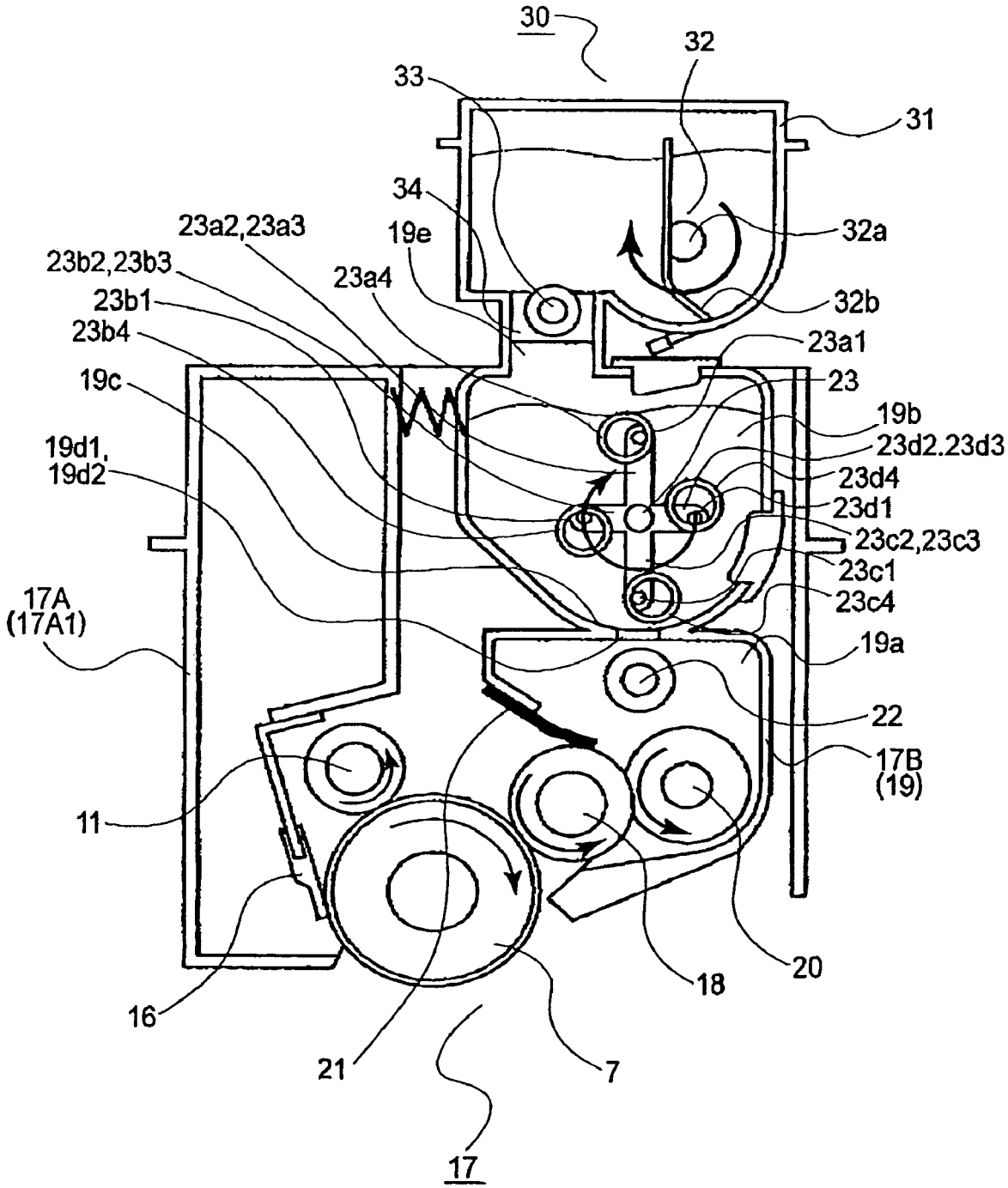
FIG. 9 is a sectional view of an image forming apparatus in which a process cartridge comprising the developing apparatus in the third embodiment of the present invention, and a developer supply container for supplying the developing apparatus with developer, are removably mountable.
Figure 10:
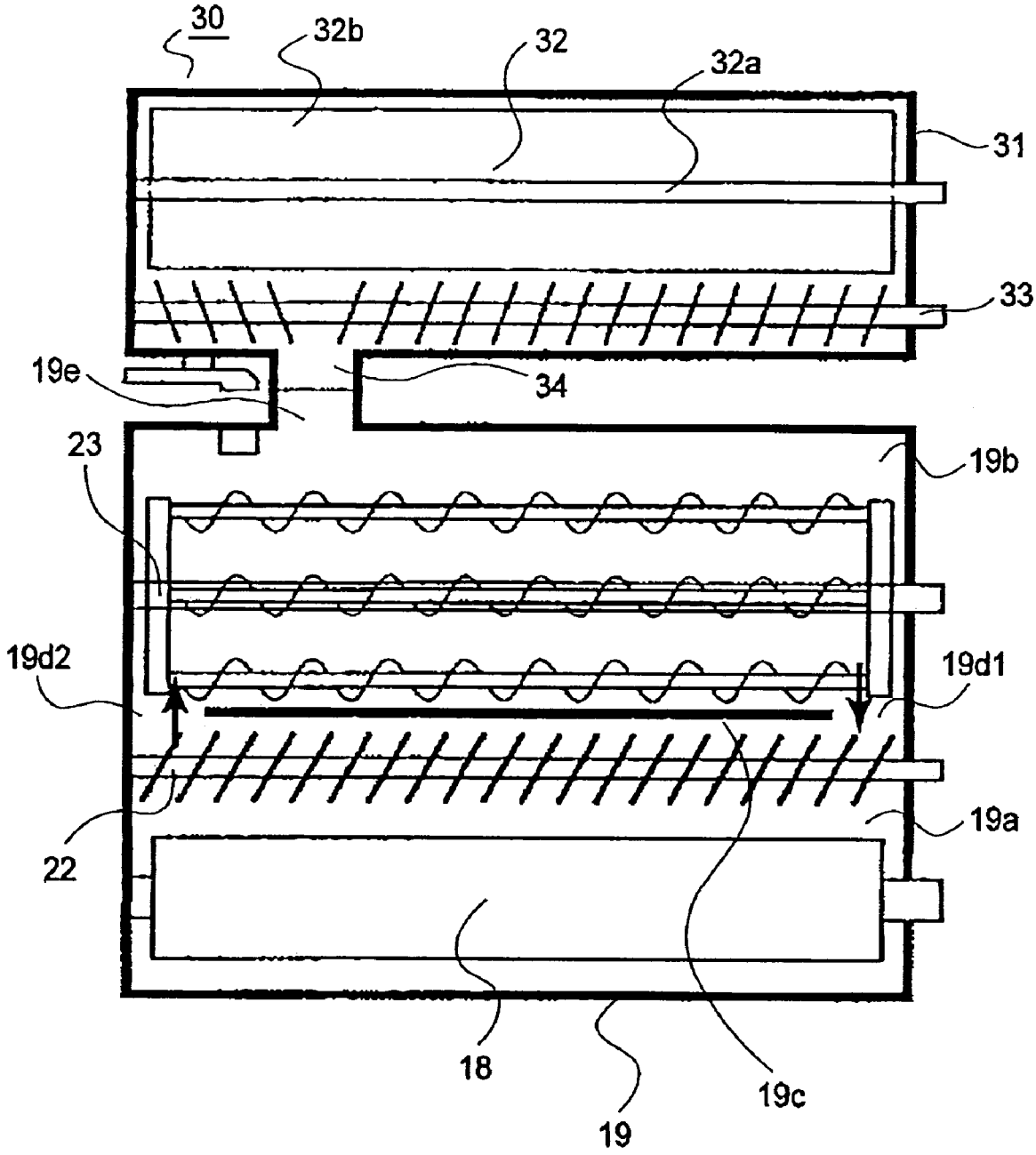
FIG. 10 is a sectional view of the right-hand portion (in FIG. 9) of the developing apparatus, inclusive of a developer container, at a plane parallel to the lengthwise direction.
Figure 11:
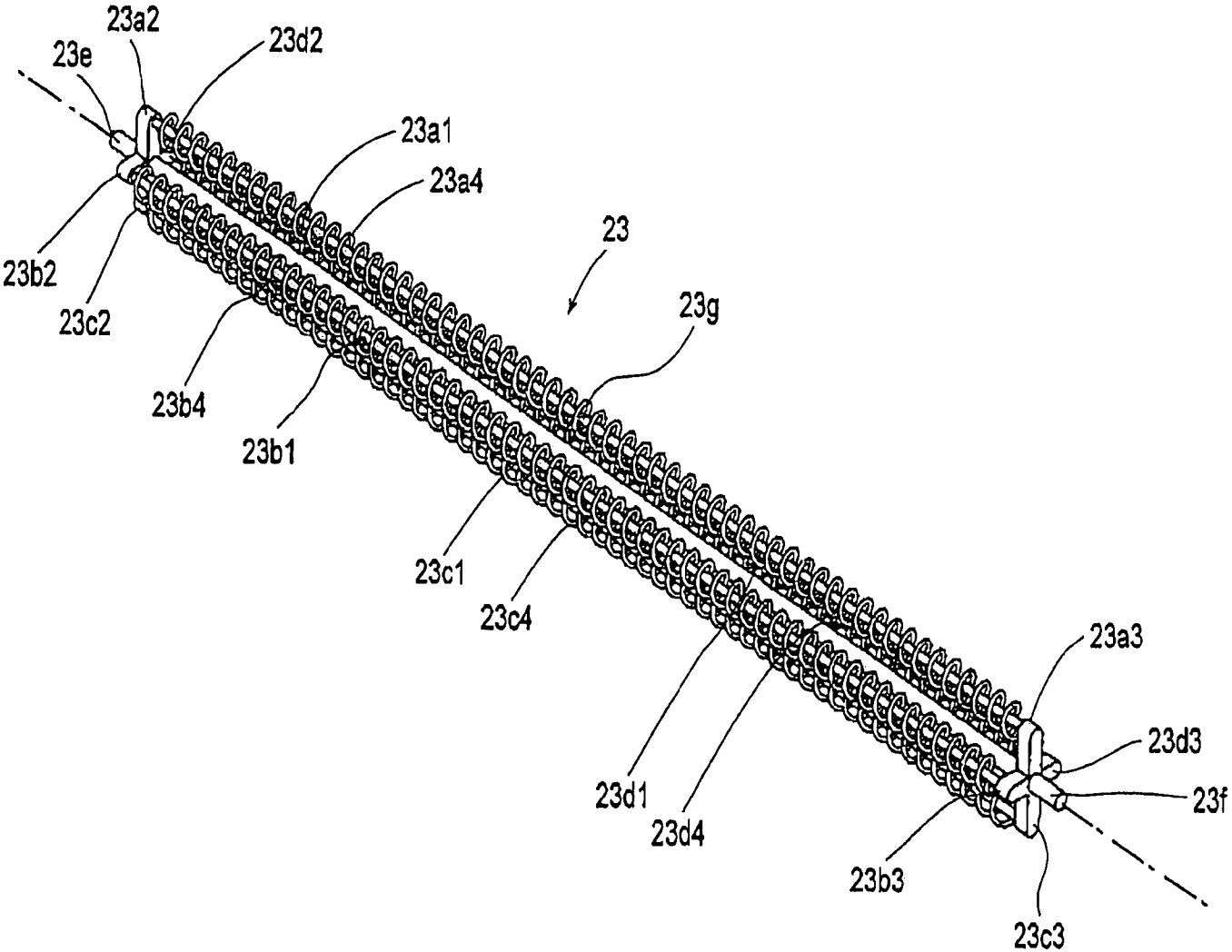
FIG. 11 is an external perspective view of a developer stirring member in the third embodiment.

Next, the third embodiment of the present invention will be described. FIG. 9 is a sectional view of the process cartridge, which comprises the developing apparatus in this embodiment and a developer supply container for supplying the developing apparatus with developer. FIG. 10 is a sectional view of the right-hand portion (in FIG. 9) of the developing apparatus, inclusive of a developer container, at a plane parallel to the lengthwise direction. FIG. 11 is an external perspective view is of the developer stirring member in this embodiment.

The structural features of the stirring member, in this embodiment, identical to those in the first embodiment, will not be described here.

[Process Cartridge]

Referring to FIG. 9, a process cartridge 17 comprises a cleaning unit 17A, and a development unit 17B as a developing apparatus, which are integrally connected to each other.

The cleaning unit 17A has a cleaning means container 17A1 as a frame for rotatably supporting the photosensitive drum 7.

In the cleaning means container 17A, a charge roller 11 and a cleaning blade 16 are disposed in addition to the photosensitive drum 7.

As for the development unit 17B, it has a developing means container 19 as a frame for rotatably supporting a development roller 18. It has an opening which faces the photosensitive drum 7 The development roller 18 is rotatably supported by the developing means container 19 so that the peripheral surface of the development roller 18 is partially exposed toward the photosensitive drum 7 through this opening of the developing means container 19, and also, so that it can be rotated in the direction indicated by an arrow mark (in drawing).

The development roller 18 has an elastic surface layer, and is kept in contact with the photosensitive drum 7 so that a predetermined amount of contact pressure is maintained between the development roller 18 and the photosensitive drum 7. A supply roller 20 as a developer supplying means as well as a developer recovering means is an elastic roller comprising a surface layer formed of elastic substance such as sponge. The supply roller 20 is disposed in contact with the development roller 18.

Next, referring to FIGS. 9 and 10, the structure of the developing apparatus will be described in detail The developing means container 19 is provided with a blade 21 as a member for regulating the thickness of the developer layer. The blade 21 is attached to the developing means container 19 so that it is kept pressed upon the peripheral surface of the development roller 18. The blade 21 is a metallic leaf spring, and is kept pressed upon the peripheral surface of the development roller 18 so that a predetermined amount of contact pressure is maintained between the blade 21 and the peripheral surface of development roller 18.

The body of developer T borne on the peripheral surface of the development roller 18 is formed into a developer layer with a predetermined thickness, while being electrically charged, by the blade 21. As a result, a thin layer of electrically charged developer T is formed on the peripheral surface of the development roller 18. From this thin layer of developer T, the developer T is supplied to the development region. The residual developer, that is, the developer T which did not contribute to the development, and which remains on the peripheral surface of the development roller 18, is stripped away from the peripheral surface of the development roller 18 by the friction from the supply roller 20. A part of the stripped developer T is supplied to the peripheral surface of the development roller 18 by the supply roller 20, along with the developer T freshly supplied to the supply roller 20, and the rest is returned to the developing means container 19.

The developing means container 19 of the development unit 17B has top and bottom chambers 19*a* and 19*b* separated by a partitioning wall 19*c*. The bottom chamber in which the development roller 18, and a developer conveying member 22, which will be described later, for conveying the developer T, are disposed is called the development chamber 19*a*, whereas the top chamber in which a stirring member 23, which will be described later, is disposed is called the stirring chamber 19*b*. The internal space of the development chamber 19*a* and the internal space of the stirring chamber 19*b* are connected only through a pair of openings 19*d*1 and 19*d*2 located at their lengthwise ends, one for one.

In the development chamber 19*a*, a screw 22 as a member for conveying developer T in the lengthwise direction of the developing means container 19 is disposed. The screw 22 conveys the developer T in the development chamber 19*a* in the lengthwise direction, and sends the developer T having fallen into the development chamber 19*a* through the opening 19*d*1, toward the center of the developing means container 19*a*. Further, the screw 22 conveys the developer T in the developing means container 19*a* to the opening 19*d*2, and sends the developer T back into the stirring chamber 19*b*.

Referring to FIG. 11, the stirring member 23 disposed in the stirring chamber 19*b* has a supporting member 23*g*, as a rotational member, comprising: rotational stirring portions 23*a*1, 23*b*1, 23*c*1, and 23*d*1, which roughly match in length to the developing means container 19; supporting portions 23*a*2, 23*b*2, 23*c*2, and 23*d*2, for supporting the rotational stirring portions 23*a*1, 23*b*1, 23*c*1, and 23*d*1, respectively, at one of their lengthwise ends; and supporting portions 23*a*3, 23*b*3, 23*c*3, and 23*d*3, for supporting the rotational stirring portions 23*a*1, 23*b*1, 23*c*1, and 23*d*1, respectively, at the other end.

The supporting member 23*g* also comprises a pair of supporting portions 23*e* and 23*f*, which extend outward from the lengthwise ends of the supporting member 23*g*, one for one, in a direction parallel to the rotational stirring portions, and by which the supporting member 23*g* is supported. The supporting portions 23*e* and 23*f* (which hereafter may be referred to as shaft portions) are rotatably supported by the lengthwise end walls of the developing means container 19, one for one. The rotational axis of the supporting member 23*g*, and the rotational axes of the supporting portions 23*e* and 23*f*, are parallel to the lengthwise direction of the developing means container 19.

The rotational stirring portions 23*a*1 and 23*c*1 are roughly symmetrically supported by the supporting member 23*g* with respect to the rotational axis of the shaft portion 23*e* (23*f*), about which the stirring member 23 is rotated, and so are the rotational stirring portions 23*b*1 and 23*d*1. However, they do not need to be roughly symmetrically supported.

In this embodiment, the distance from the shaft portion 23*e* to the supporting portion 23*a*2, the distance from the shaft portion 23*e* to the supporting portion 23*c*2, the distance from the shaft portion 23*f* to the supporting portion 23*a*3, and the distance from the shaft portion 23*f* to the supporting portion 23*c*3 are rendered greater than the distance from the shaft portion 23*e* to the supporting portion 23*b*2, the distance from the shaft portion 23*e* to the supporting portion 23*d*2, the distance from the shaft portion 23*f* to the supporting portion 23*b*3, and the distance from the shaft portion 23*f* to the supporting portion 23*d*3. With this structural arrangement, the tracks of the rotational stirring portions 23*a*1 and 23*c*1 are greater in diameter than the tracks of the rotational stirring portions 23*b*1 and 23*d*1.

The rotational stirring portions 23*a*1, 23*b*1, 23*c*1, and 23*d*1 of the stirring member 23 are externally fitted with mobile stirring portions 23*a*4, 23*b*4, 23*c*4, and 23*d*4, respectively, in the form of a coil, so that the mobile stirring portions are allowed to move relative to the rotational stirring portions 23*a*1, 23*b*1, 23*c*1, and 23*d*1, respectively. More specifically, in this embodiment, the mobile stirring portions 23*a*4, 23*b*4, 23*c*4, and 23*d*4 are loosely fitted around the rotational stirring portions 23*a*1, 23*b*1, 23*c*1, and 23*d*1 so that the mobile stirring portions 23*a*4, 23*b*4, 23*c*4, and 23*d*4 are allowed to move relative to the rotational stirring portions 23*a*1, 23*b*1, 23*c*1, and 23*d*1, in the directions parallel to their axial and radius directions, as well as circumferential directions, of the mobile stirring portions 23*a*4, 23*b*4, 23*c*4, and 23*d*4, respectively This setup, however, is not intended to limit the present invention in applicability. That is, the former may be fitted around the latter so that the former are allowed to move relative to the latter, only in one direction among the axial, radius, and circumferential directions of the former, or only in two directions among the abovementioned three directions. Incidentally, the internal diameters of the mobile stirring portions 23*a*4, 23*b*4, 23*c*4, and 23*d*4 are greater than the external diameters of the rotational stirring portions 23*a*1, 23*b*1, 23*c*1, and 23*d*1, respectively.

In this embodiment, the external diameters of the rotational stirring portions 23*a*1, 23*b*1, 23*c*1, and 23*d*1 are in the range of 1 mm-7 mm, whereas the internal diameters of the mobile stirring portions 23*a*4, 23*b*4, 23*c*4, and 23*d*4 are in the range of 1.5-15 mm, allowing thereby the mobile stirring portions to move relative to the corresponding rotational stirring portions. The mobile stirring portions in the form of a coil can be made by spirally winding a piece of wire, the diameter of which is in the range of 0.3-3 mm, so that the resultant coil will be 1-10 mm in pitch, and 1.5-15 mm in internal diameter.

As the stirring member 23 is rotated, the developer T in the stirring chamber 19*b* is stirred by being raked.

The screw 22 and stirring member 23 are connected to the development roller 18 and supply roller 20 through a gear train (unshown). Therefore, during an image forming operation, that is, while the development roller 18 is rotated, the screw 22 and stirring member 23 are rotated together. The rotation of the screw 22 and stirring member 23 stops at the end of the image forming operation.

[Developer Supply Container]

Referring to FIGS. 9 and 10, above the development unit 17B, a developer supply container 30 is disposed, which is structurally independent from the process cartridge 17. The developer supply container 30 is provided with a stirring member 32 and a screw 33, which are disposed in the developer storage portion 31 of the developer supply container 30. The developer storage portion 31 is provided with an opening 34 as a developer supply outlet. The stirring member 32 is a member for loosening the developer T in the developer storage portion 31. The screw 33 is for conveying the developer T from the developer storage portion 31 to the stirring chamber 19*b* The developer supply outlet 34 is positioned so that when the developer supply container 30 is attached to the main assembly 10 of the image forming apparatus, the developer supply outlet 34 aligns with the developer inlet 19*e* located at the top of the development unit 17B.

The stirring member 32 and screw 33 are rotatably supported by the developer storage portion 31, by their lengthwise ends. They are rotationally driven in response to a supply command from the apparatus main assembly 10. The stirring member 32 is made up of: a rotational shaft 32*a* as a base member; and stirring plates 32*b* formed of a flexible sheet (for example, sheet of polyethylene terephthalate). The screw 33 is made up of a rotational shaft and spiral ribs attached to the rotational shaft.

As the developer supply controller (unshown) determines, based on the information obtained by detecting the amount of toner remaining in the developing apparatus, that the developer needs to be supplied from the developer supply container 30 to the process cartridge 17, it issues a command for rotating the screw 33 by the rotation of the driving coupling (unshown). As a result, the developer T is conveyed by the rotation of the screw 33 to the developer supply outlet 34, and free-falls through the developer supply outlet 34, replenishing thereby the process cartridge 17 with the developer T through the developer inlet 19*e*. Therefore, the amount of the developer T in the developing means container 19 remains virtually constant.

[Toner Circulation in Developer Container]

Next, the circulation of the developer T in the developing means container 19 in this embodiment will be described. The developer T in the development chamber 19*a* is conveyed in one of the lengthwise directions by the screw 22 as a member for conveying the developer T in the lengthwise direction, and is sent to the stirring chamber 19*b* by the pressure from the screw 22 through the opening 19*d*2. In order to make as long as possible the length of time the developer T is stirred in the stirring chamber 19*b*, the developer inlet 19*e* through which the developer T in the developer supply container 30 is delivered to the stirring chamber 19*b* is positioned at the same lengthwise end as the opening 19*d*2.

The stirring member 23 is rotated by the driving force transmitted thereto through a gear train (unshown), stirring the developer T as is the stirring member in the first embodiment. The stirring member 23 is capable of leveling the body of developer T in the stirring chamber 19*b*, which is the only function given to the stirring member 23; it is not given the function of conveying the developer T in a specific direction. Therefore, no matter how many times the rotational stirring portions 23*a*1, 23*b*1, 23*c*1, and 23*d*1 are rotated, it does not occur that the developer T is aggressively conveyed to the opening 19*d*1, which is the entrance to the development chamber 19*a*. To describe further the movement of the developer T in the stirring chamber 19*b*, as the developer T is sent into the stirring chamber 19*b* from the development chamber 19*a* through the opening 19*d*2, or is supplied into the stirring chamber 19*b* from the developer supply container 30, the developer T builds up in the adjacencies of the opening 19*d*2, or developer supply inlet 19*e*. This buildup of developer T is leveled by the rotation of the stirring member 23. Thus, as the rotation of the stirring member 23 continues, the developer T is spread across the stirring chamber 19*b*, eventually reaching the opening 19*d*1, through which it falls into the development chamber 19*a*. Then, the developer T is supplied to the development roller 18 while being conveyed toward the lengthwise center of the development chamber 19*a*. This is how the developer T is circulated through the stirring chamber 19*b* and development chamber 19*a*.

As described above, in this embodiment, it does not occur that the developer T in the developing means container 19 is non-uniformly stirred. Therefore, it does not occur that the developer T in specific areas of the developing means container 19 deteriorates at much higher rate than the developer T in other areas of the developing means container 19. Therefore, it is possible to control the deterioration of the developer T in the developing means container 19.

Further, the stirring member 23 in the stirring chamber 19*b* is not enabled to convey the developer T in the lengthwise direction of the stirring chamber 19*b*. Therefore, the developer T remains in the stirring chamber 19*a* for a substantial length of time, even though the developing means container 19 is structured so that the developer T is allowed to freely move between the development chamber 19*a* and the stirring chamber 19*b* (this embodiment can make it possible to deliberately keep the developer T in the stirring chamber 19*b* for a substantial length of time). Thus, the developer T supplied to the stirring chamber 19*b* is mixed with the developer T pre-existing in the developing means container 19, for a long time. In other words, the developer T pre-existing in the developing means container 19, and the developer T freshly supplied to the developing means container 19, are supplied to the development roller 18 after being thoroughly stirred and mixed. Therefore, the various problems (formation of defective images, for example) attributable to the insufficient stirring of the developer T do not occur (this embodiment can prevent various problems attributable to insufficient stirring of developer T).

In the preceding embodiments of the present invention, the plurality of rotational stirring portions and plurality of mobile stirring portions are attached to a single rotational member. Therefore, not only can the plurality of rotational stirring portions be rotated by the rotation of the single rotational member to which they are attached, but also, the plurality of the mobile stirring portions can be moved relative to the corresponding rotational stirring portions by the same rotation of the single rotational member.

Further, the preceding embodiments are not intended to limit the scope of the present invention. That is, in the preceding embodiments, the mobile stirring portions are in the form of a coil, or a circular ring. However, the mobile stirring portions may be in a form different from a coil or circular ring, as long as the form does not contradict the gist of the present invention. It should be noted here, however, that when the mobile stirring portions are circular in cross section, that is, when they are in the form of a coil or a circular ring, they can stir developer more smoothly than when they are not circular in cross section.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 250736/2004 and 054126/2005 filed Aug. 30, 2004 and Feb. 28, 2005, which is hereby incorporated by reference.

What is claimed is:

1. A developing apparatus for developing an electrostatic latent image formed on an electrophotographic photosensitive member with a developer in an electrophotographic image forming apparatus, said developing apparatus comprising:

a developer accommodating portion configured to accommodate the developer to be supplied to a developing member;

a developer stirring member configured and positioned to stir the developer in said developer accommodating portion, said developer stirring member including a rotatable member rotatably provided in said developer accommodating portion, a first stirring rotatable portion provided on said rotatable member, a first movable stirring portion movably provided on said first stirring rotatable portion, a second stirring rotatable portion provided on said rotatable member, and a second movable stirring portion movably provided on said second stirring rotatable portion, and wherein a radius of rotation of said first stirring rotatable portion and a radius of rotation of said second stirring rotatable portion are different from each other, and a part of a stirring region in which said first stirring rotatable portion and said first movable stirring portion stir the developer and a part of a stirring region in which said second stirring rotatable portion and said second movable stirring portion stir the developer, overlap.

2. An apparatus according to claim 1, wherein said first stirring rotatable portion comprises a linear shaft member.

3. An apparatus according to claim 1 or 2, wherein said second stirring rotatable portion comprises a linear shaft member.

4. An apparatus according to claim 2, wherein said first movable stirring portion comprises a coil having an inner diameter which is larger than an outer diameter of said first stirring rotatable portion, and said first stirring rotatable portion penetrates said coil.

5. An apparatus according to claim 3, wherein said second movable stirring portion comprises a coil having an inner diameter which is larger than an outer diameter of said second stirring rotatable portion, and said second stirring rotatable portion penetrates said coil.

6. An apparatus according to claim 2, wherein said first movable stirring portion comprises a ring having an inner diameter which is larger than an outer diameter of said first stirring rotatable portion, and said first stirring rotatable portion penetrates said ring.

7. An apparatus according to claim 3, wherein said second movable stirring portion comprises a ring having an inner diameter which is larger than an outer diameter of said second stirring rotatable portion, and said second stirring rotatable portion penetrates said ring.

8. An apparatus according to claim 6, wherein said ring has a circular inside.

9. An apparatus according to claim 8, wherein said developing apparatus is a developing cartridge detachably mountable to a main assembly of the electrophotographic image forming apparatus.

10. An apparatus according to claim 1 or 2, wherein said developing apparatus is unified with the electrophotographic photosensitive member into a process cartridge detachably mountable to a main assembly of the electrophotographic image forming apparatus.

11. An apparatus according to claim 7, wherein said ring has a circular inside.

* * * * *

UNITED STATES PATENT AND TRADEMARK OFFICE

CERTIFICATE OF CORRECTION

PATENT NO. : 7,257,353 B2
APPLICATION NO. : 11/094372
DATED : August 14, 2007
INVENTOR(S) : Tachio Kawai et al.

It is certified that error appears in the above-identified patent and that said Letters Patent is hereby corrected as shown below:

ON THE TITLE PAGE, At Item (57), Abstract
Line 3, "apparatus" should read --apparatus.--.
Line 18, "stirs" should read --stir--.

COLUMN 6
Line 23, "but," should read --but--.

COLUMN 12
Line 47, "is of" should read --of--.

COLUMN 17
Line 29, "is" should read --are--.

Signed and Sealed this

Twenty-fourth Day of February, 2009

John Doll

JOHN DOLL
*Acting Director of the United States Patent and Trademark Office*